US006868705B2

(12) United States Patent
Miao

(10) Patent No.: US 6,868,705 B2
(45) Date of Patent: Mar. 22, 2005

(54) LOCK WITH A SLIDING BLOCK MOVABLY RECEIVED IN THE CONTROL KNOB TO SELECTIVELY DRIVE THE LATCH

(75) Inventor: Tony Miao, Taishan Hsiang (TW)

(73) Assignee: Jin Tay Industries Co., LTD, Taishan Hsiang (TW)

( * ) Notice: Subject to any disclaimer, the term of this patent is extended or adjusted under 35 U.S.C. 154(b) by 56 days.

(21) Appl. No.: 10/608,161

(22) Filed: Jun. 27, 2003

(65) Prior Publication Data

US 2004/0261479 A1 Dec. 30, 2004

(51) Int. Cl.[7] ..... E05B 27/00; E05B 29/00

(52) U.S. Cl. ..... 70/492; 70/222; 70/367; 70/379 R

(58) Field of Search ..... 70/492, 490, 367, 70/352, 375–377, 491, 215, 216, 379 R, 70/379 A, 380, 189, 222, 223

(56) References Cited

U.S. PATENT DOCUMENTS

| | | | | | |
|---|---|---|---|---|---|
| 1,918,411 | A * | 7/1933 | Lowe | 70/223 |
| 3,263,461 | A * | 8/1966 | Tartaglia | 70/383 |
| 4,689,977 | A * | 9/1987 | Wolniak et al. | 70/379 R |
| 5,263,348 | A * | 11/1993 | Wittwer | 70/379 R |
| 5,265,453 | A * | 11/1993 | Konii et al. | 70/379 R |
| 5,265,464 | A * | 11/1993 | Crocco et al. | 70/380 |
| 5,651,280 | A * | 7/1997 | Park | 70/472 |
| 5,765,417 | A * | 6/1998 | Bolton | 70/495 |
| 5,816,086 | A * | 10/1998 | Russell, IV | 70/422 |
| 6,041,630 | A * | 3/2000 | Shen | 70/472 |
| 6,550,299 | B1 * | 4/2003 | Lin | 70/491 |
| 6,584,819 | B1 * | 7/2003 | Hung | 70/491 |
| 6,711,924 | B2 * | 3/2004 | Ritz | 70/422 |

* cited by examiner

*Primary Examiner*—John B. Walsh
(74) *Attorney, Agent, or Firm*—David A. Belasco; Belasco Jacobs & Townsley, LLP

(57) ABSTRACT

A lock includes a control knob with a keyway and a receiving space defined in a distal end face of the control knob to correspond to the receiving hole of the sliding seat. The sliding block is able to selectively be received at a joint of the control knob and the sliding block to allow movement of the control knob to drive the latch to move accordingly.

4 Claims, 5 Drawing Sheets

LOCK WITH A SLIDING BLOCK MOVABLY RECEIVED IN THE CONTROL KNOB TO SELECTIVELY DRIVE THE LATCH

BACKGROUND OF THE INVENTION

1. Field of the Invention

The present invention relates to a lock, and more particularly to a lock with a sliding block movably received in the control knob such that the pivotal movement of the control knob is able to drive the latch to move accordingly.

2. Description of Related Art

When referring to a lock with a pivotal control knob and a latch driven by the pivotal movement of the control knob, normally, the latch is firmly mounted on the control knob so that when the control knob is pivoted, the latch is driven to rotate in a direction the same as that of the control knob. When the latch is rotated, the latch is able to connect/disconnect to a locking bar which is firmly mounted on a surface to switch between a locking/unlocking status. In general, a wide variety of different elements may be involved to firmly mount the latch on the control knob, which complicates the structure of the lock and hence the manufacture cost is high. Furthermore, the user will need to use the key all the time to switch between locking and unlocking status, which is quite troublesome.

To overcome the shortcomings, the present invention tends to provide an improved lock to mitigate and obviate the aforementioned problems.

SUMMARY OF THE INVENTION

The primary objective of the present invention is to provide an improved lock with a sliding block movably received in the control knob to selectively combine the control knob and the sliding seat so that the latch is able to be driven to complete a temporary locking/unlocking status. Therefore, a key to the lock is unnecessary when a temporary lock/unlocking is required.

Another objective of the present invention is to provide first stop on an outer periphery of the sliding seat and a second stop on an inner periphery of the casing to correspond to the first stop such that the engagement between the first stop and the second stop prevent excessive movement of the sliding seat relative to the casing.

Other objects, advantages and novel features of the invention will become more apparent from the following detailed description when taken in conjunction with the accompanying drawings.

DETAILED DESCRIPTION OF THE PREFERRED EMBODIMENT

Figure 1:
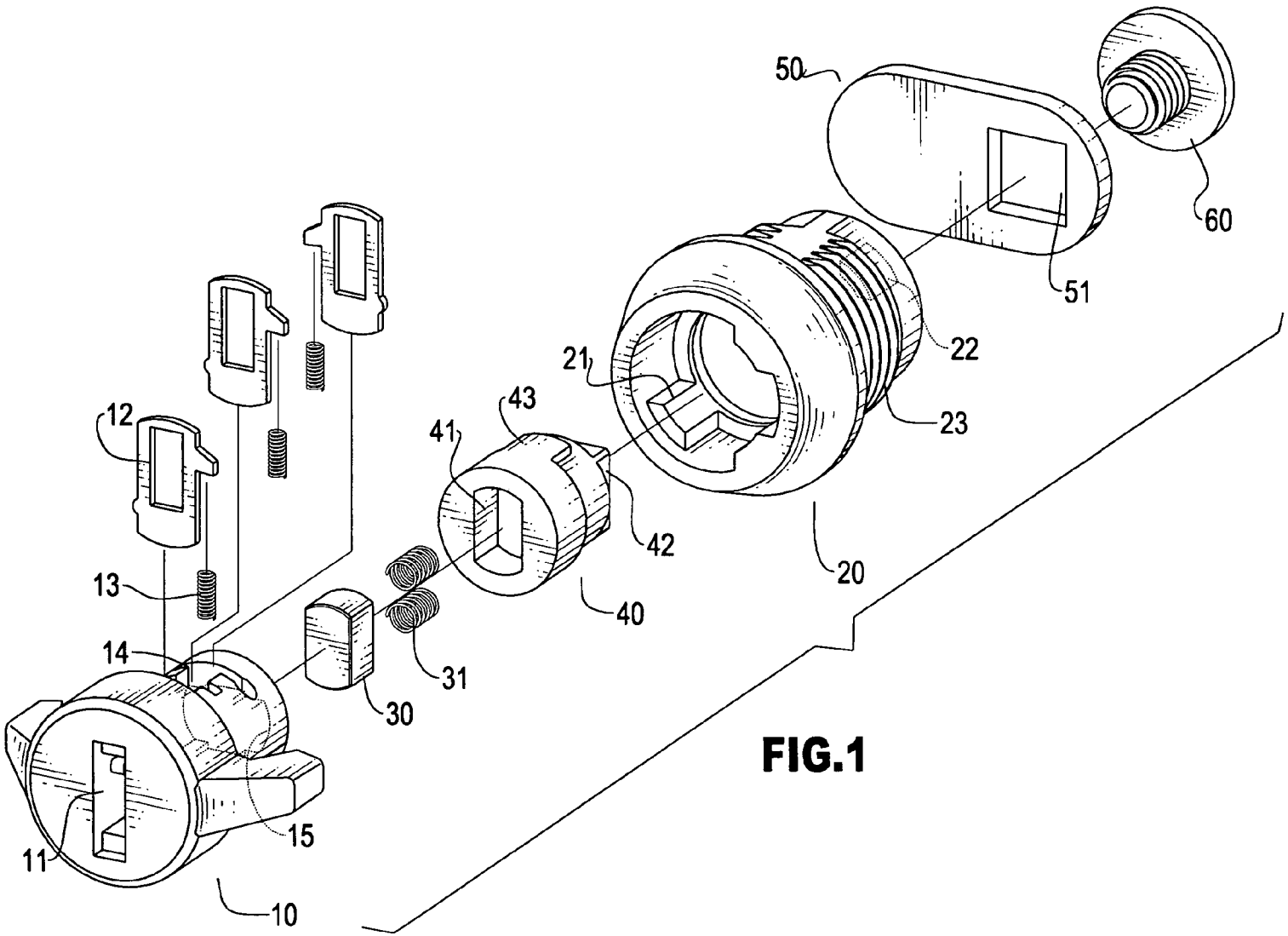
FIG. 1 is an exploded perspective view of the lock of the present invention.

With reference to FIG. 1, the lock in accordance with the present invention has a control knob (10), a sliding block (30), a sliding seat (40), a casing (20), a latch (50) and a plug (60).

The control knob (10) has a keyway (11) centrally defined in the control knob (10) to allow an extension of a key (not shown), multiple locking slits (14) defined through a periphery of the control knob (10) to respectively receive therein a locking plate (12) and a spring (13) and a receiving space (15) defined in a free end face of the control knob (10) to communicate with the keyway (11). However, the principle of the movement of the locking plates (12) and the springs (13) which are received in the corresponding locking slits (14) is well known in the art so that detailed description of how the locking plates (12) are moved according to different situation is thus omitted herein.

The sliding block (30) is a cube, preferably, a hexahedron. At least one expansion spring (31) (two are shown in the embodiment) is provided to the sliding block (30).

The sliding seat (40) has a receiving hole (41) defined to correspond to the sliding block (30), a connection end (42) formed on a free end of the sliding seat (40) and opposite to the place where the receiving hole (41) is defined and a first stop (43) formed on an outer periphery of the sliding seat (40).

Preferably, the receiving space (15) has a shape and a size corresponding to the shape and the size of the sliding block (30) and the shape and the size of the receiving hole (41) so that the sliding block (30) is able to be received in the receiving space (15) which will be further explained in the following description.

The casing (20) is a hollow cylinder and has two open ends. Multiple baffle blocks (21) close to one open end are formed on an inner face of the casing (20) and equally spaced apart from each other. A second stop (22) is oppositely formed on the inner face of the casing (20) to correspond to the first stop (43) of the sliding seat (40).

The latch (50) has a through hole (51) defined to correspond to the connection end (42) of the sliding seat (40).

Figure 2:
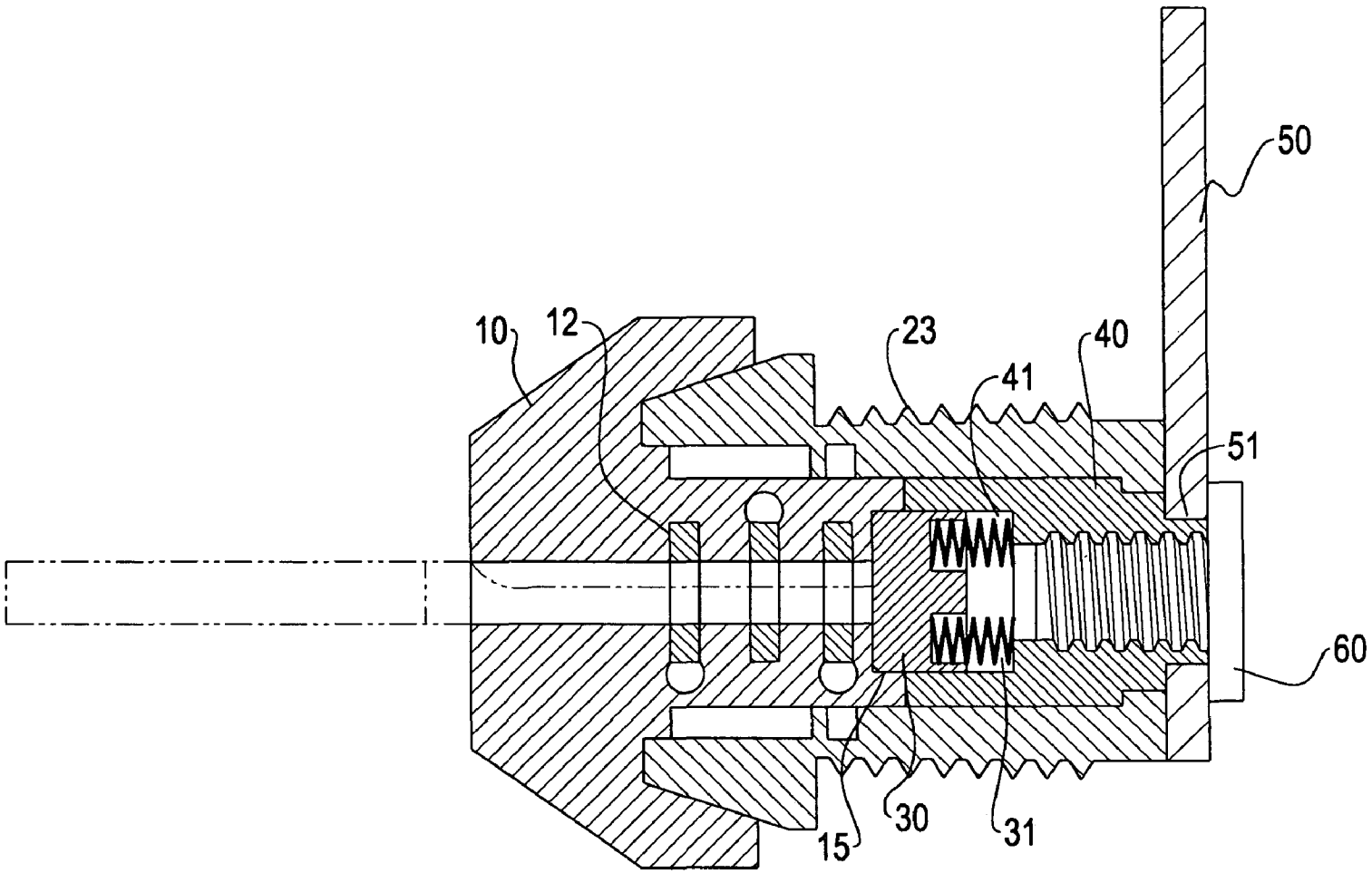
FIG. 2 is a schematic cross sectional view showing the assembled lock in FIG. 1.

With reference to FIG. 2, when the lock of the present invention is in assembly, firstly, the sliding block (40) is received in the casing (20) with the connection end (42) extending out of the casing (20) and through the through hole (51) of the latch (50). The plug (60) is then applied to threadingly connected to the connection end (42) to secure the connection among the sliding seat (40), the casing (20) and the latch (50). Thereafter, the sliding block (30) together with the expansion spring (31) is received in the receiving hole (41) of the sliding seat (40) while the control knob (10) with the locking plates (12) and the springs (13) received therein is inserted into the casing (20) to secure the connection therewith. It is notable that after the assembly, the first stop (43) is corresponded to the second stop (22) and the locking plates (12) are limited by the baffle blocks (21).

Figure 3:
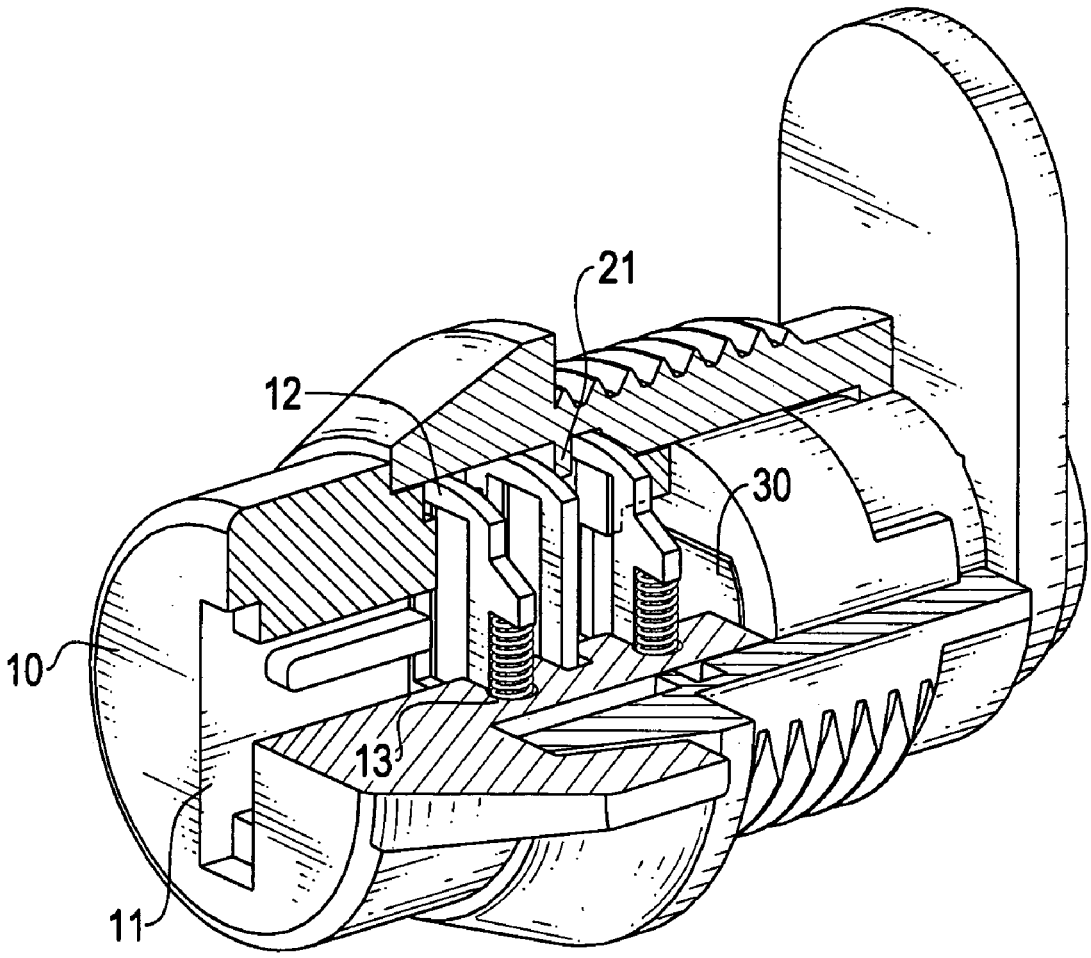
FIG. 3 is a perspective view with partial in cross section to show the lock of the present invention is in a locking status.

With reference to FIG. 3, after the assembly of the lock of the present invention, the locking plates (12) are limited by the baffle blocks (21) so that there is no relative rotation permitted between the control knob (10) and the casing (20). Similarly, due to the abutment of the distal end face of the control knob (10), the sliding block (30) is forced to be completely received in the receiving hole (41) and thus the expansion spring (31) is compressed between a bottom face defining the receiving hole (41) and a face of the sliding block (30).

Figure 4:
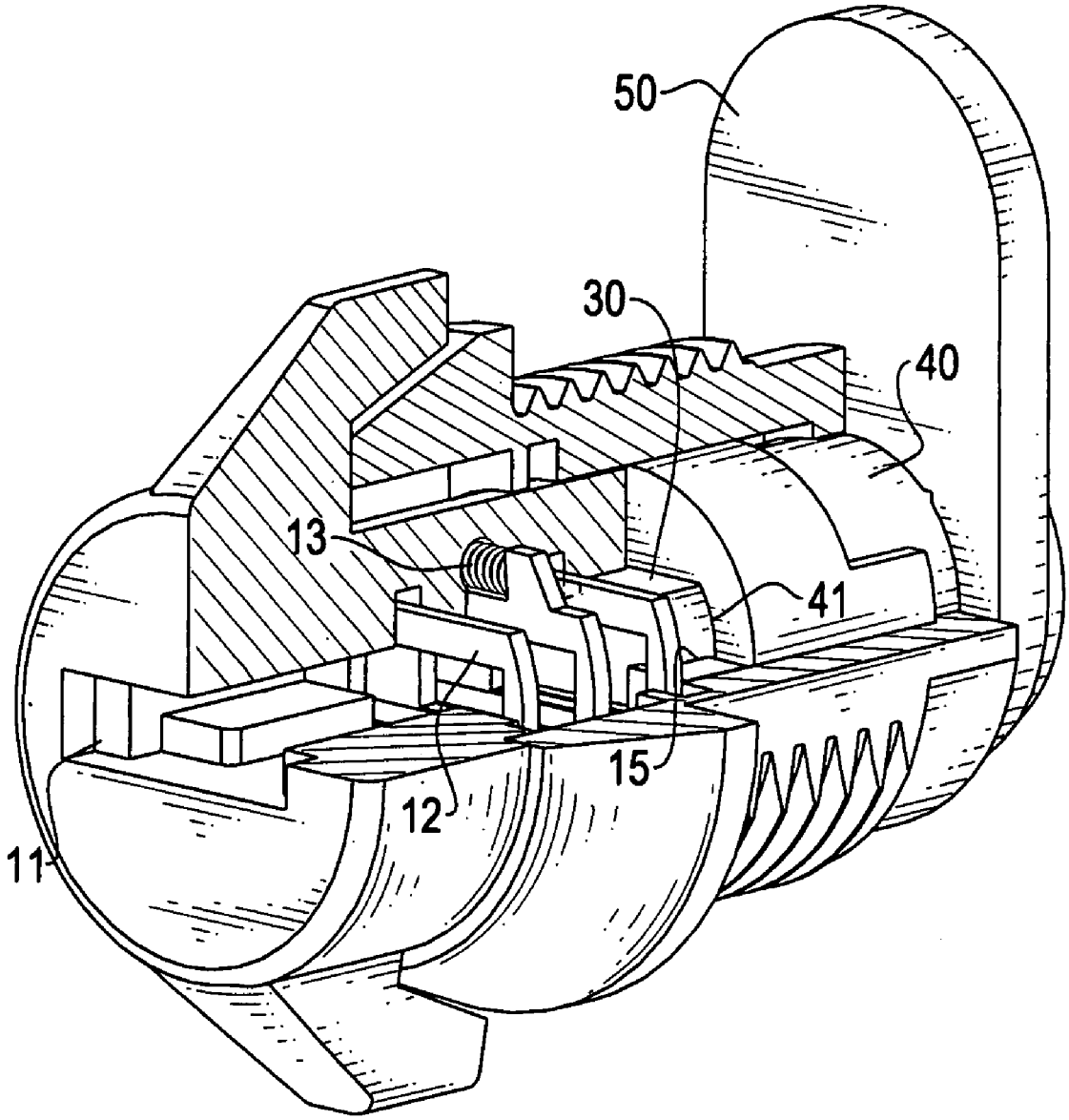
FIG. 4 is a perspective view with partial in cross section to show the lock of the present invention is in an unlocking status, wherein the sliding block is sandwiched between the control knob and the sliding seat.
Figure 5:
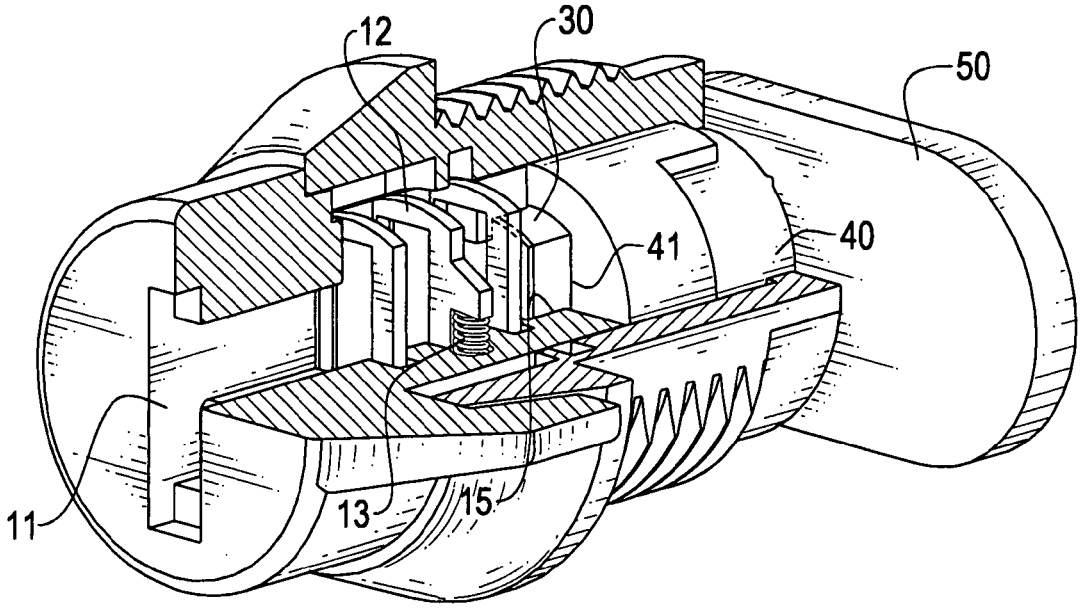
FIG. 5 is a s a perspective view with partial in cross section to show the control knob is pivoted to drive the latch to move accordingly when the sliding block is sandwiched between the control knob and the sliding seat.

With reference to FIGS. 4 and 5, when a proper key (shown in dashed lines in FIG. 2) is inserted into the keyway (11) of the control knob (10), the locking plates (12) fall into the locking slits (14) to compress the springs (13), which allows the control knob (10) to rotate relative to the casing (20). While the control knob (10) is rotating relative to the casing (20), the receiving space (15) of the control knob (10) aligns with the receiving hole (41) to allow the sliding block (30) to pop out of the receiving hole (41) due to the compressed expansion spring (31). After the sliding block (30) is popped out via the release of the compressed expansion spring (31), the sliding block (30) combines the control knob (10) and the sliding seat (40) which is securely connected to the latch (50). It is noted that during the combination of the control knob (10) and the sliding seat (40), the control knob (10) is rotated such that all the locking plates (12) are kept within the locking slits (14), which allows the control knob (10) together with the sliding seat (40) to rotate relative to the casing (20).

Thereafter, the user is able to rotate the control knob (10) to drive the latch (50) to rotate accordingly. Furthermore, when the key is removed, the rotatable movement of the control knob (10) still is able to drive the latch (50) to rotate because the control knob (10) and the sliding block (40) is still combined. Thus, the user is able to complete a temporary locking/unlocking status without the key. Further, in order to avoid excessive rotation of the combination of the control knob (10) and the sliding seat (40) relative to the casing (20), the first stop (43) and the second stop (22) will engage with each other so that the combination of the control knob (10) and the sliding seat (40) can only rotate within a certain range.

If the key is inserted into the keyway (11) again to push the sliding block (30) back into the receiving hole (41) of the sliding seat (40) and the control knob (10) is rotated to misalign the receiving space (15) and the receiving hole (41), the rotation of the control knob (10) is no longer possible due to the abutment of the locking plates (12) to the inner periphery of the casing (20).

Therefore, the user of the lock of the present invention is able to use the key to complete a permanent locking status or to perform a temporary locking/unlocking status without the key via the alignment of the receiving hole (41) and the receiving space (15).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lock comprising:

a hollow casing having two open ends, multiple baffle blocks formed on an inner periphery of the casing close to one of the open ends;

a sliding seat rotatably received in the casing and having a receiving hole defined in a first end face of the sliding seat and a connection end formed on a second end face of the sliding seat to extend out of the casing to firmly connect to a latch;

a sliding block movably received in the receiving hole; and a control knob with a keyway defined inside the control knob for receiving therein a key, multiple locking plates and springs respectively received in a corresponding one of multiple locking slits defined through an outer periphery of the control knob to communicate with the keyway and a receiving space defined in a distal end face of the control knob to correspond to the receiving hole of the sliding seat such that the sliding block is able to be selectively received at a joint of the control knob and the sliding block to allow movement of the control knob to drive the latch to move accordingly.

2. The lock as claimed in claim 1 further comprising an expansion spring received between the sliding block and a bottom face defining the receiving hole so that the expansion spring is compressed when the sliding block is entirely received in the receiving hole and the expansion spring is released when the sliding block is located at the joint.

3. The lock as claimed in claim 1, wherein the sliding seat has a first stop formed on an outer periphery of the sliding seat to correspond to a second stop formed on the inner periphery of the casing close to the other open end so that rotation of the sliding seat inside the casing is limited when the first stop engages with the second stop.

4. The lock as claimed in claim 2, wherein the sliding seat has a first stop formed on an outer periphery of the sliding seat to correspond to a second stop formed on the inner periphery of the casing close to the other open end so that rotation of the sliding seat inside the casing is limited when the first stop engages with the second stop.

* * * * *